US005416985A

United States Patent [19]

Culp

[11] Patent Number: 5,416,985

[45] Date of Patent: May 23, 1995

[54] CENTER BRIDGING PANEL FOR DRYING GREEN LUMBER IN A KILN CHAMBER

[76] Inventor: George Culp, 318 S. Main St., New London, Stanley County, N.C. 28127

[21] Appl. No.: 126,089

[22] Filed: Sep. 23, 1993

[51] Int. Cl.[6] ..... F26B 21/06

[52] U.S. Cl. ..... 34/487; 34/231

[58] Field of Search ..... 34/306, 443, 462, 463, 34/464, 465, 466, 487, 488, 492, 518, 218, 222, 226, 229, 230, 231

[56] References Cited

U.S. PATENT DOCUMENTS

| | | | |
|---|---|---|---|
| Re. 15,316 | 3/1922 | Weiss . | |
| 217,022 | 7/1879 | Robbins . | |
| D. 328,137 | 7/1992 | Warrent et al. . | |
| 473,116 | 3/1892 | Hay . | |
| 528,496 | 10/1894 | Williams . | |
| 555,067 | 2/1896 | Bemis . | |
| 620,114 | 2/1899 | Ferrell . | |
| 620,869 | 3/1899 | Horton . | |
| 942,150 | 12/1909 | Tiemann . | |
| 1,054,597 | 2/1913 | Moore . | |
| 1,212,583 | 1/1917 | Tanner . | |
| 1,276,979 | 8/1918 | Sidman . | |
| 1,328,662 | 1/1920 | Fish, Jr. . | |
| 1,339,374 | 5/1920 | Buensod . | |
| 1,432,248 | 10/1922 | Hirt . | |
| 1,467,306 | 9/1923 | Carrier . | |
| 1,497,362 | 6/1924 | Dhe . | |
| 1,539,817 | 5/1925 | Thelen . | |
| 1,541,433 | 6/1925 | Nikaido . | |
| 1,594,549 | 8/1926 | Noel . | |
| 1,603,103 | 10/1926 | Anderson . | |
| 1,693,395 | 11/1928 | Lawton . | |
| 1,774,208 | 8/1930 | Mueller | 34/231 |
| 1,778,586 | 10/1930 | Cobb | 34/231 |
| 1,840,523 | 1/1932 | Mueller . | |
| 1,863,934 | 6/1932 | Rubin . | |
| 1,919,646 | 7/1933 | Woolhouse . | |
| 1,972,346 | 9/1934 | Juline . | |
| 1,989,998 | 2/1935 | Mueller | 34/231 |
| 2,085,634 | 6/1937 | Cobb . | |
| 2,213,668 | 9/1940 | Dundas et al. . | |
| 2,315,285 | 3/1943 | Dennington . | |
| 2,318,027 | 5/1943 | Sykes et al. . | |
| 2,380,518 | 7/1945 | Gottschalk et al. | 34/518 |
| 2,388,184 | 10/1945 | Ripper . | |
| 2,448,288 | 8/1948 | Alk . | |
| 2,538,888 | 1/1951 | Smith . | |
| 2,718,713 | 9/1955 | Bloxham . | |
| 3,129,071 | 4/1964 | Meredith | 34/231 |
| 3,149,932 | 9/1964 | Bachrich . | |
| 3,337,967 | 8/1967 | Smith . | |
| 3,386,186 | 6/1968 | Tiefenbach . | |
| 3,598,067 | 8/1971 | Jones . | |
| 3,659,352 | 5/1972 | Cook . | |
| 3,675,600 | 7/1972 | Jones . | |
| 3,680,219 | 8/1972 | Koch . | |
| 3,716,004 | 2/1973 | Jones . | |
| 3,900,957 | 8/1975 | Denton et al. . | |
| 4,014,107 | 3/1977 | Bachrich . | |
| 4,188,878 | 2/1980 | Kahnau . | |
| 4,199,870 | 4/1980 | Arsenault . | |
| 4,250,629 | 2/1981 | Lewis . | |
| 4,343,095 | 8/1982 | Rosen et al. . | |
| 4,663,860 | 5/1987 | Beall . | |
| 4,753,020 | 6/1988 | Brunner | 34/230 |
| 4,788,777 | 12/1988 | Davis . | |
| 4,955,146 | 9/1990 | Bollinger | 34/191 |
| 4,972,604 | 11/1990 | Breckenridge . | |

*Primary Examiner*—Henry A. Bennet
*Assistant Examiner*—William C. Doerrler
*Attorney, Agent, or Firm*—Bell, Seltzer, Park & Gibson

[57] ABSTRACT

A kiln system for drying green lumber to a predetermined moisture content according to the present invention includes a kiln chamber for enclosing a charge of lumber consisting of a number of laterally spaced rectangular solid stacks of lumber, a fan above the lumber for circulating air through the kiln chamber and through the lumber and a first elongate center bridging panel above the stacks of lumber and overlying each vertically extending air space defined between adjacent, laterally spaced stacks of lumber. The elongate center bridging panel includes a center portion having opposed side edges which extends laterally substantially across the air space. The center bridging panel also includes first and second side portions hingedly connected to the opposed edges of the center portion. The center bridging panel substantially prevents circulating air from rising above the stacks of lumber in the vertically extending air space. Accordingly, the circulating air is forced to flow through each successive stack of lumber to more evenly and efficiently dry the lumber.

30 Claims, 2 Drawing Sheets

CENTER BRIDGING PANEL FOR DRYING GREEN LUMBER IN A KILN CHAMBER

FIELD OF THE INVENTION

The present invention relates to the field of kiln drying and, more particularly, to a kiln drying method and apparatus which forces air to circulate through each successive stack of lumber in a kiln chamber for improving the drying process.

BACKGROUND OF THE INVENTION

Lumber which has recently been cut and machined contains a relatively large percentage of water and is referred to as green lumber. Prior to being used in construction or other applications which demand good grades of lumber, the green lumber must be dried to remove a relatively large percentage of water from the lumber. Acceptable water content will vary with the application as well as the type of wood, however, in many circumstances, a moisture content of 19% or less is an acceptable water content.

Although lumber may be air dried, kiln drying accelerates and provides increased control over the drying process. In kiln drying, charges of lumber are placed in a kiln chamber. A typical kiln chamber is a generally rectangular building which can be sealed to control the introduction and exhaust of air. Further, such kiln chambers typically have reversible fans for circulating the air through the chamber.

The charge of lumber placed in the kiln generally consists of a number of rectangular solid stacks of lumber. Each stack of lumber, in turn, typically consists of a number of vertically stacked, horizontal rows of lumber that form a rectangular solid. The horizontal rows are spaced apart for air to pass between the rows using wooden boards referred to as "stickers" that have a relatively small lateral cross-sectional area in relation to the lateral cross-sectional area of the lumber forming the charge. The stickers are generally spaced apart between each horizontal row to allow air to flow between the rows.

Typically, the stacks of lumber are placed on separate wheeled, flat bed cars which are mounted for movement on railroad-type tracks. Kilns may have any desired number of tracks. Multi-track kilns may therefore accept several stacks of lumber during each drying cycle.

In operation, a charge of green lumber is initially placed in a kiln chamber. After sealing the kiln chamber, the air within the kiln is heated to facilitate drying. The air may be heated in a number of ways such as by heat transfer from pipes extending through the kiln chamber in which steam flows. Alternatively, heated air may be introduced such as from a furnace. Kilns which utilize the introduction of heated air are typically referred to as direct fired kilns.

Fans generally positioned in upper portions of the kiln and above the stacked lumber circulate the heated air through the kiln chamber, including the stacks of lumber. Because the stickers provide spacing between the horizontal rows of lumber, the heated air passes between the rows of lumber and is in direct contact with both the upper and lower surfaces of the individual pieces of lumber. The fans continually recirculate the air through the kiln and the lumber to further dry the lumber. Periodically, a portion of the circulating air is exhausted from the kiln and additional air is introduced into the kiln. The additional air is typically heated in the kiln chamber, such as by heat transfer from the steam pipes. This periodic exhaust and replacement process allows circulating air which has absorbed a large amount of moisture from the green lumber to be removed, while drier air is introduced to accelerate the lumber's drying.

Within such kilns, the circulating air flows in a generally circular pattern. More particularly, fans above the stacks of lumber direct air laterally over the top of the lumber in a first direction. When the air contacts a first sidewall of the kiln chamber, the bulk of the air is forced downward by the fans and the ceiling of the kiln chamber. The circulating air subsequently flows through the spaces between the horizontal rows of lumber established by the stickers in a second, lateral direction opposite the first lateral direction. Upon contact with a second sidewall of the kiln chamber, the air rises and is recirculated by the fans through the lumber. Periodically, the fans are reversed such that the air flows in the opposite direction to provide generally consistent drying of the lumber.

In standard multi-track kilns, adjacent stacks of lumber typically define a narrow, vertically extending air space between the stacks. The circulating heated air will rise in this air space between adjacent first and second stacks of lumber. Depending upon the width of the air space, the air's circulation speed, and the distance between the circulating air and the top of the stacks when the air enters the air space from the first stack of lumber, the air may rise above the stacks of lumber. Consequently, such air would be recirculated without ever passing through the second stack of lumber.

As a result, the second stack of lumber would not be dried as thoroughly as the first stack of lumber. This uneven drying of the stacks of lumber may result in the production of inferior grades of lumber, including lumber with increased warping and cracking. If the drying is continued until the second stack of lumber is sufficiently dry in an attempt to avoid the production of inferior grades of lumber, the time and expense required to dry the lumber will significantly increase and the first stack of lumber may actually be dried too much. Further, as the same amount of air does not circulate through each stack of lumber, the consistency and predictability with which the lumber may be dried, i.e., the determination of appropriate drying times for which the lumber must remain in the kiln to ensure adequate moisture removal, is hindered.

OBJECT AND SUMMARY OF THE INVENTION

Accordingly, it is an object of the present invention to provide a method and apparatus for covering the vertically extending air space between adjacent stacks of lumber in a kiln chamber and limiting the amount of air rising above the stacks of lumber such that the air circulating in the kiln chamber passes through each successive stack of lumber to evenly and thoroughly dry the lumber.

In one embodiment, the present invention includes an elongate center bridging panel above stacks of lumber which are enclosed within a kiln chamber and overlying each vertically extending air space defined between adjacent stacks of lumber. The elongate center bridging panel limits the quantity of air rising above the stacks of lumber from within the vertically extending air space and instead, forces the air to pass through successive stacks of lumber to thoroughly and evenly dry the lumber.

In another embodiment, the elongate center bridging panel includes a horizontal center portion and first and second side portions hingedly connected to opposite sides of the center portion. The hinged side portions may be raised during introduction and removal of the charge of lumber and be extended downwardly once the charge of lumber has been positioned to contact an upper surface of the lumber.

The foregoing and other objects, advantages and features of the invention, and the manner in which the same are accomplished, will become more readily apparent upon consideration of the following detailed description of the invention taken in conjunction with the accompanying drawings, which illustrate preferred and exemplary embodiments, and wherein:

DETAILED DESCRIPTION OF A PREFERRED EMBODIMENT

Figure 1:
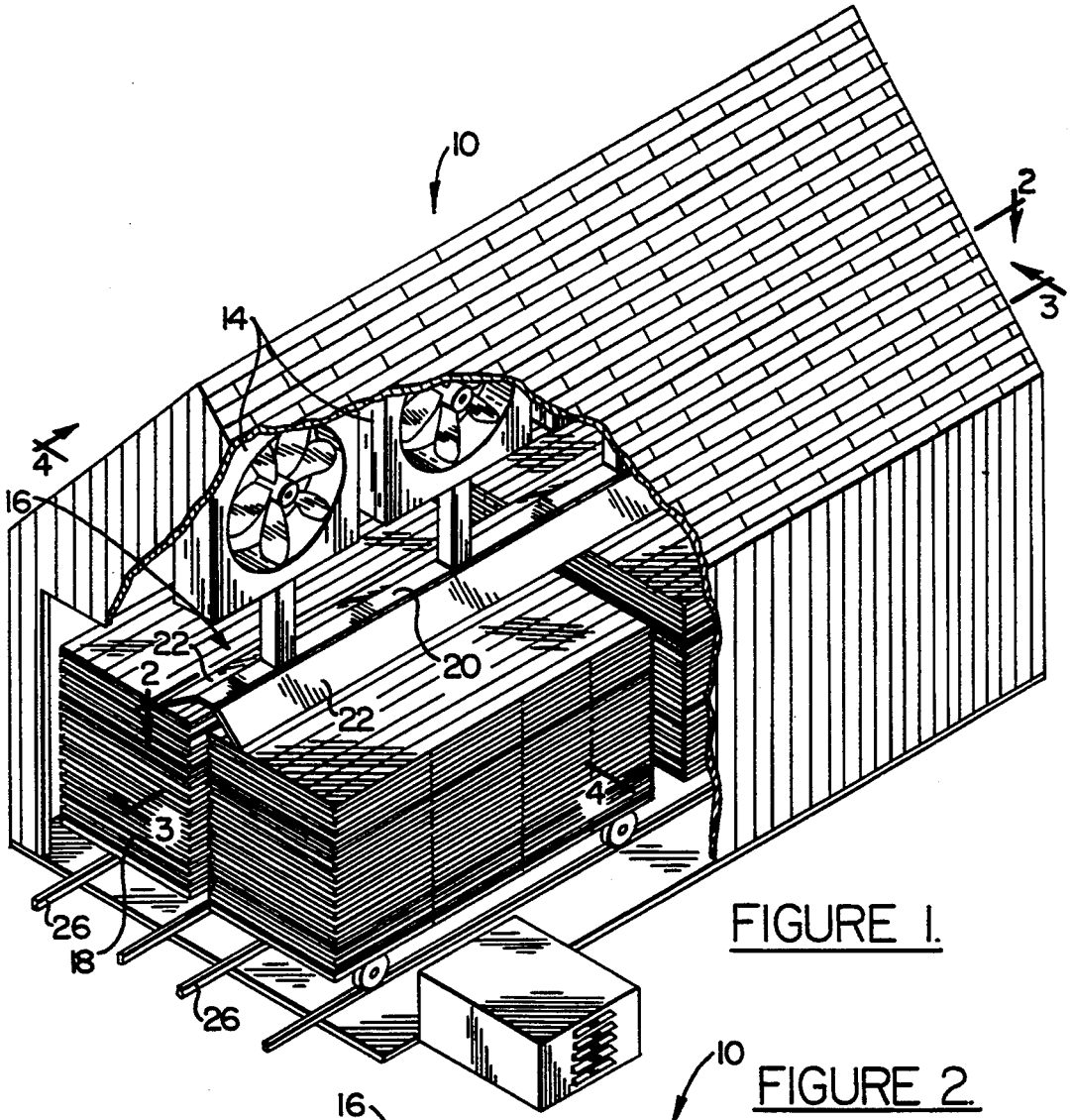
FIG. 1 is a fragmented perspective view of a kiln system according to the present invention.

The present invention is a method and apparatus for improving the circulation of air through a kiln chamber and, consequently, increasing the efficiency with which green lumber is dried. As illustrated in FIG. 1, a kiln chamber 10 for drying lumber is illustrated. The kiln chamber 10 has a lower portion defining a generally rectangular solid space for enclosing a charge of lumber. The charge of lumber is preferably comprised of rectangular solid stacks of lumber. It will be understood, however, that the phrase "rectangular solid" is used descriptively, rather than as a limitation, and represents the general interior shape of a typical kiln, or the portion of some other shape of kiln that will hold a stack of lumber to be dried.

Figure 2:
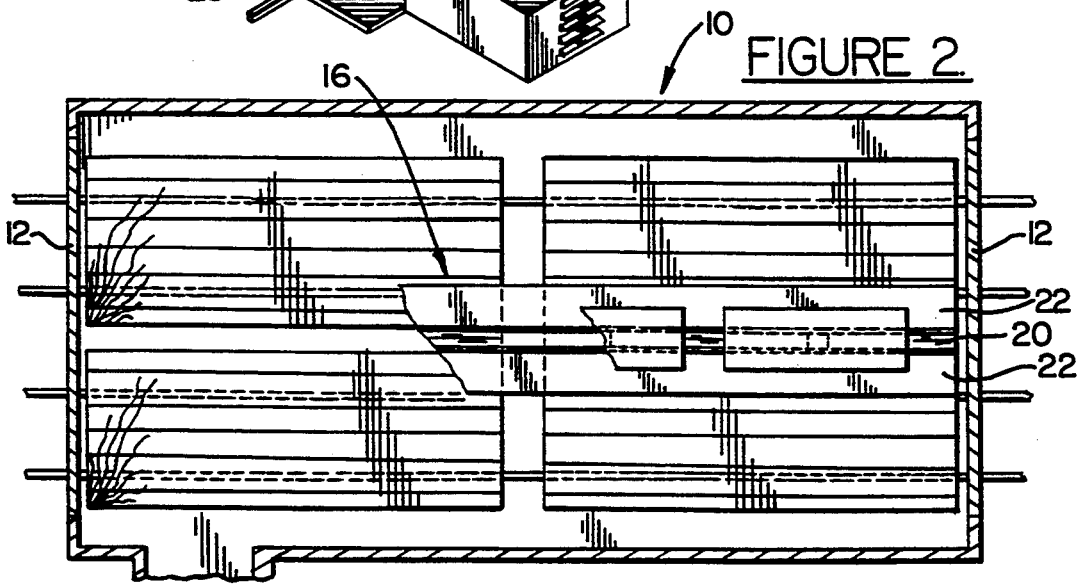
FIG. 2 is a cross-sectional plan view of the kiln system according to the present invention taken along line 2—2 of FIG. 1.

The kiln chamber 10 also preferably includes a set of doors 12 on one sidewall of the kiln chamber 10 and, more preferably, two sets of doors on opposed sidewalls. The doors 12 allow lumber to be inserted and withdrawn from the kiln chamber 10. For a kiln chamber 10 having two sets of doors 12 on opposed sidewalls as illustrated in FIG. 2, lumber may be inserted through a first set of doors and withdrawn from a second set of doors, thus increasing the efficiency of the lumber handling. The doors 12 also allow the kiln chamber 10 to be sealed to control the introduction and exhaust of air.

The kiln chamber 10 also includes at least one fan 14. More preferably, the kiln chamber 10 includes a plurality of longitudinally spaced fans 14 for circulating air laterally through the kiln chamber 10. The fans 14 are generally positioned in upper portions of the kiln chamber above the generally rectangular solid space. The fans 14 circulate air through the kiln chamber 10 and the lumber in the kiln chamber 10 in order to draw moisture from the lumber to dry the lumber to an acceptable moisture level. The fans 14 are also preferably reversible to allow the direction of airflow through the kiln chamber 10 to be altered so as to more evenly dry the lumber.

According to the present invention, an elongate center bridging panel 16 is positioned above the rectangular solid stacks of lumber 18. The elongate center bridging panel 16 overlies each vertically extending air spaced between adjacent, laterally spaced stacks of lumber 18. As illustrated in FIGS. 1 and 2 for a kiln chamber 10 adapted to receive a charge of lumber consisting of two laterally spaced rectangular solid stacks of lumber 18, a single elongate center bridging panel 16 overlies the vertically extending air space between the two stacks of lumber 18. However, a plurality of elongate center bridging panels 16 may be utilized for a kiln chamber 18 adapted to receive three or more laterally spaced rectangular solid stacks of lumber 18 since each vertically extending air space between adjacent, laterally spaced stacks of lumber 18 is preferably covered by an elongate center bridging panel 16. Accordingly, for a kiln chamber adapted to receive N laterally spaced rectangular solid stacks of lumber, $(N-1)$ center bridging panels would preferably overlie the $(N-1)$ vertically extending air spaces between the adjacent, laterally spaced stacks of lumber.

As illustrated in FIG. 1, the elongate center bridging panel 16 includes a center portion 20 having opposed side edges 21. The center portion 20 extends laterally substantially across the air space between adjacent, laterally spaced stacks of lumber 18. More preferably, the center portion 20 of the elongate center bridging panel 16 extends substantially horizontally above the vertically extending air space.

Figure 4:
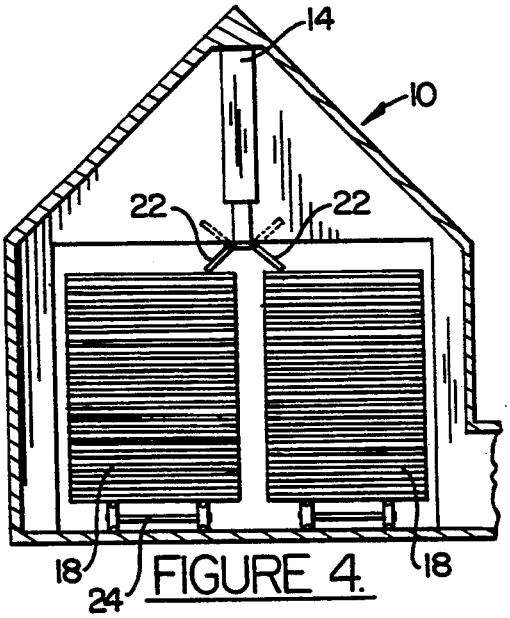
FIG. 4 is a cross-sectional lateral view of the kiln system according to the present invention taken along line 4—4 of FIG. 1.

Each elongate center bridging panel 16 also preferably includes first and second side portions 22 hingedly connected to the opposed edges 21 of the center portion The first and second side portions 22 of the elongate center bridging panels 16 extend downwardly from the center portion 20 to contact the upper surfaces of adjacent laterally spaced stacks of lumber 18 as illustrated in FIG. 4. This contact with the upper surfaces of adjacent, laterally spaced stacks of lumber 18 further prevents air from rising above the stacks of lumber from the vertically extending air space.

As illustrated in FIG. 4, the hinged connection of the first and second side portions 22 to the center portion 20 of the elongate center bridging panel 16 facilitates insertion and withdrawal of the charge of lumber from the kiln chamber 10. For example, the first and second side portions 22 may be raised when the charge of lumber is inserted into or withdrawn from the kiln chamber 10. Subsequently, the hinged first and second side portions 22 may be lowered to contact the upper surfaces of adjacent, laterally spaced stacks of lumber 18.

Accordingly, the elongate center bridging panel 16 substantially prevents circulating air from rising above the stacks of lumber 18 from the vertically extending air space. Thus, the circulating air is forced to circulate through and draw moisture from successive, adjacent stacks of lumber in order to improve the efficiency of the drying process.

The generally rectangular solid stacks of lumber 18 are typically placed on wheeled cars 24, such as flat bed rail cars, mounted on rail tracks 26 which are preferably formed in the floor of the kiln chamber 10. The wheeled cars 24 facilitate insertion and withdrawal of the stacks of lumber 18 from the kiln chamber 10. Although a kiln chamber 10 having two laterally adjacent tracks of lumber is illustrated, one skilled in the art will know that a kiln chamber incorporating the present invention may include three or more tracks of lumber.

Further, since the length of the kiln chamber 10 is typically greater than the length of the pieces of green lumber being dried, the charge of lumber preferably includes a longitudinal row of a plurality of rectangular solid stacks 18 of lumber. Further, each longitudinal row of lumber is preferably inserted on one track with the wheeled cars upon which the rectangular solid stacks 18 of lumber are carried being coupled together. Accordingly, the longitudinal row of lumber may be inserted and withdrawn as an unit.

Figure 3:
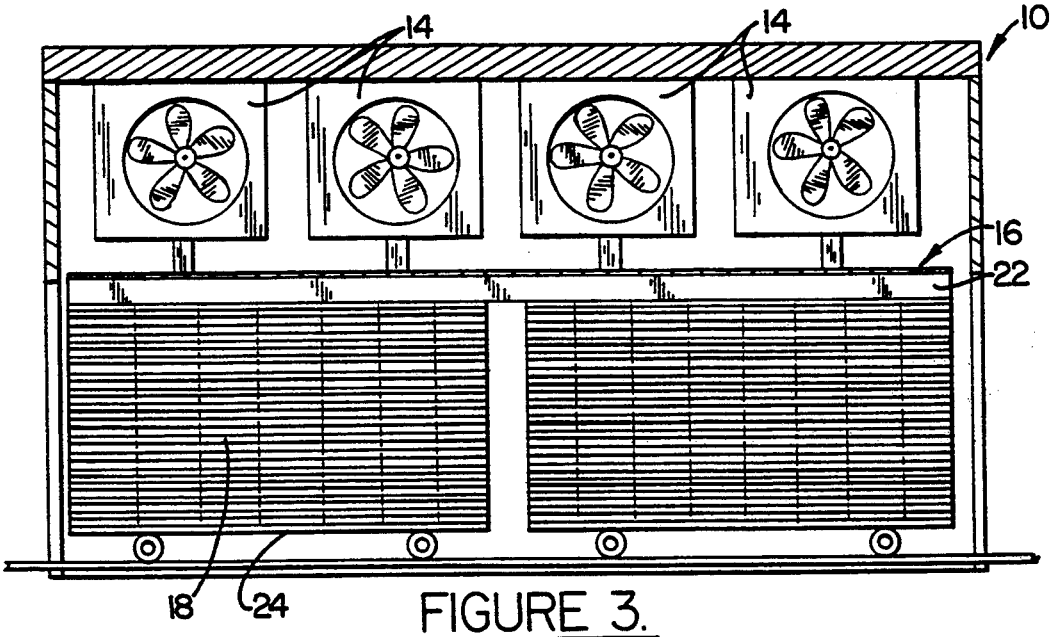
FIG. 3 is a cross-sectional side view of the kiln system according to the present invention taken along line 3—3 of FIG. 1.

Regardless of the number of wheeled cars per track, the kiln chamber 10 is adapted to receive a charge of lumber comprised of at least one rectangular solid stack 18 of lumber and having a predetermined maximum length. Correspondingly, the length of each center bridging panel 16 is preferably substantially equal to the predetermined maximum length of the charge of lumber as illustrated in FIG. 3. More particularly, for a charge of lumber 18 comprised of a plurality of individual rectangular solid stacks of lumber, the elongate center bridging panel 16 preferably extends along the entire length of the charge of lumber so as to cover the vertically extending air spaces defined between each laterally spaced pair of stacks 18 of lumber.

In further preferred embodiments, the kiln system of the present invention also includes means for heating the circulating air in the kiln chamber 10 since the circulation of heated air further accelerates the drying process by withdrawing larger quantities of moisture from the lumber. The heating means may include all those known to one skilled in the art, including, without limitation, an external furnace 26 for heating the air prior to its introduction to the kiln chamber 10. Alternatively, the kiln chamber 10 may include pipes extending through the kiln chamber 10 in which heated steam flows such that heat is transferred from the steam flowing through the pipes to the circulating air within the kiln chamber 10.

In other preferred embodiments illustrated in FIG. 4, the plurality of stacked rows of lumber are spaced apart such that air may flow between the rows to increase the lumber's drying. This spacing is preferably provided by the placement of a plurality of spaced apart stickers 28, typically pieces of lumber having a relatively small cross-sectional dimensions in proportion to the cross-sectional dimensions of the lumber being dried, between each row of lumber.

Figure 5:
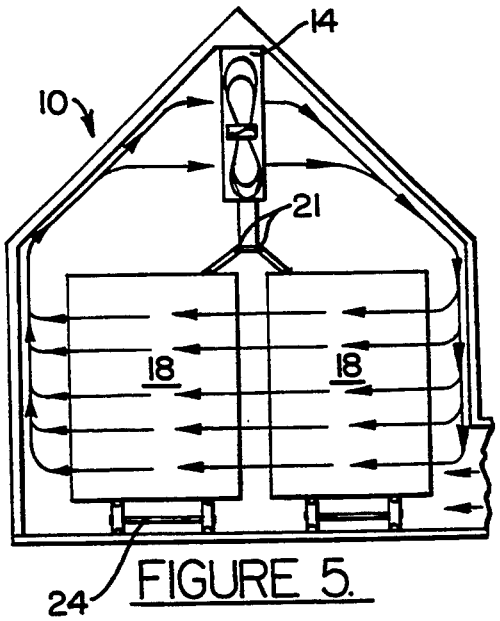
FIG. 5 is a cross-sectional lateral view of the kiln system according to the present invention illustrating a typical airflow pattern through the kiln chamber and through the lumber in the kiln chamber.

In operation, a charge of lumber consisting of a plurality of rectangular solid stacks of green lumber 18 having a relatively large moisture content is introduced into the kiln chamber 10. The kiln chamber 10 is subsequentially sealed such that air may be controllably introduced into and exhausted from the kiln chamber 10. As illustrated in FIG. 5, the air within the sealed kiln chamber 10 is circulated through the stacks of lumber 18 to draw moisture from the stacks. According to the present invention, the circulating air that exits from one of the stacks is restricted from rising above the plurality of stacks of lumber 18 in the air space. Instead, the circulating air is forced to flow through each successive stack of lumber 18 in the kiln chamber 10. Thus, the lumber in each stack is more evenly and efficiently dried. However, even though the circulating air is restricted from rising above the plurality of stacks of lumber 18, a portion of the circulating air preferably flows over and dries the upper surface of each of the rectangular solid stacks of lumber 18 to a moisture level substantially equal to the moisture level of the remainder of each stack of lumber.

In preferred embodiments, at least a portion of the air is recirculated through the stacks of lumber 18 in the kiln chamber 10 to further dry the stacks of lumber. This recirculation of air includes the selective exhaust of a portion of the circulating air containing moisture drawn from the stacks of lumber 18 and the introduction of additional air into the kiln chamber 10. Preferably, the additional air has a lower moisture content than the exhausted air and is introduced into the kiln chamber 10 to more rapidly draw moisture from the stacks of lumber 18 than the exhausted air, thus, further increasing the efficiency of the drying process. In further preferred embodiments, the air is heated prior to its circulation to further facilitate moisture removal from the stacks of lumber 18. Once the lumber has reached an acceptable moisture level, such as 19% or less, or the lumber has been in the kiln chamber 10 for a predetermined length of time, the doors 12 of the kiln chamber 10 may be opened and the charge of lumber removed.

In the specification, typical preferred embodiments of the invention have been disclosed and, although specific terms have been employed, they have been used in the generic and descriptive sense only and not for purposes of limitation, the scope of the invention being set forth in the following claims.

What I claim is:

1. A kiln system for drying green lumber to a predetermined moisture content, said kiln system comprising:

a kiln chamber, lower portions of which define a generally rectangular solid space for enclosing a charge of lumber wherein the charge of lumber comprises a plurality of laterally spaced rectangular solid stacks of lumber with vertically extending air spaces therebetween;

a fan in upper portions of said kiln chamber and above said generally rectangular solid space for circulating air through said chamber and through stacked lumber in said chamber to thereby dry the lumber; and an elongate bridging panel centered upon and overlying each vertically extending air space defined between adjacent, laterally spaced stacks of lumber when such stacks are placed in said solid space, said centered elongate bridging panel comprising a center portion having opposed side edges and extending laterally substantially across the air space, and first and second side portions hingedly connected to the opposed edges of the center portion for substantially restricting circulating air from passing said centered panel and rising above the stacks of lumber in the vertically extending air space to thereby force the circulating air through an adjacent stack of lumber to more evenly dry the plurality of stacks of lumber.

2. A kiln system according to claim 1 wherein the first and second side portions of said elongate center bridging panel extend downwardly from the center portion to contact the upper surfaces of adjacent, laterally spaced stacks of lumber when such stacks are placed in said solid space.

3. A kiln system according to claim 1 wherein the center portion of said elongate center bridging panel extends substantially horizontally above the vertically extending air space.

4. A kiln system according to claim 1 wherein said kiln chamber has a length sufficient to receive a charge of lumber having a predetermined maximum length and said center bridging panel has a length at least as long as the predetermined maximum length of the charge of lumber.

5. A kiln system according to claim 1 wherein said kiln chamber has a length sufficient to receive a charge of lumber comprised of a longitudinal row of a plurality of individual stacks of lumber wherein each longitudinal row has a predetermined maximum length, and wherein said elongate center bridging panel has a length at least as long as the predetermined maximum length.

6. A kiln system according to claim 1 further comprising a plurality of longitudinally spaced fans in upper portions of said kiln chamber and above the generally rectangular solid space.

7. The combination of a kiln system for drying green lumber to a predetermined moisture content and a charge of lumber, said combination comprising:

a kiln chamber, lower portions of which define a generally rectangular solid space;

a charge of lumber comprising a plurality of laterally spaced rectangular solid stacks of lumber enclosed in said solid space for being dried therein;

a fan in upper portions of said kiln chamber and above said generally rectangular solid space for circulating air through said chamber and through stacked lumber in said chamber to thereby dry the lumber; and an elongate horizontal bridging panel centered above and overlying each vertically extending air space that is defined between adjacent, laterally spaced stacks of lumber, said centered elongate bridging panel comprising a center portion extending laterally substantially across the air space and longitudinally along the entire length of said stack for substantially restricting circulating air from passing said centered panel and rising above the stacks of lumber in the vertically extending air space to thereby force the circulating air through an adjacent stack of lumber to more evenly dry the plurality of stacks of lumber.

8. The combination of a kiln system and lumber according to claim 7 wherein said center bridging panel further comprises first and second side portions hingedly connected to opposite sides of the center portion and extending downwardly therefrom to contact the upper surfaces of adjacent rectangular solid stacks of lumber such that circulating air is restricted from rising above the stacks of lumber in the vertically extending air space.

9. The combination of a kiln system and lumber according to claim 7 wherein said kiln chamber has a length sufficient to receive a charge of lumber having a predetermined maximum length and said center bridging panel has a length at least as long as the predetermined maximum length of the charge of lumber.

10. The combination of a kiln system and lumber according to claim 7 wherein said kiln chamber has a length sufficient to receive a charge of lumber comprised of a longitudinal row of a plurality of individual stacks of lumber wherein each longitudinal row has a predetermined maximum length, and wherein said elongate center bridging panel has a length at least as long as the predetermined maximum length.

11. The combination of a kiln system and lumber according to claim 7 wherein said plurality of rectangular solid stacks of lumber comprises first and second laterally spaced, rectangular solid stacks of lumber and wherein said kiln system further comprises a plurality of longitudinally spaced fans in upper portions of said kiln chamber and above the vertically extending air space between the first and second stacks of lumber.

12. A method for drying a charge of lumber comprising a plurality of rectangular solid stacks of green lumber to a predetermined moisture level in a sealed kiln chamber wherein adjacent stacks of lumber define a substantially vertically extending air space therebetween, and wherein the introduction and circulation of air into, through and from the kiln chamber and the lumber is controlled, the method comprising:

circulating air through the kiln chamber and through the stacks of lumber therein to draw moisture from and to dry the lumber; and preventing circulating air that exits from one of the stacks from rising above the plurality of stacks of lumber in the vertically extending air spaces therebetween such that the air circulates through each successive stack of lumber in the kiln chamber to thereby dry the lumber in each stack more evenly and efficiently.

13. A method for drying lumber according to claim 12 wherein the step of preventing circulating air from rising above the stacks includes the step of covering a portion of the air space extending between the upper surfaces of adjacent stacks of lumber to prevent air from rising above the stacks of lumber in the air space.

14. A method for drying lumber according to claim 12 and further comprising recirculating at least a portion of the air that has passed through the kiln chamber at least once through the plurality of stacks of lumber in said kiln chamber to thereby dry the lumber.

15. A method for drying lumber according to claim 14 wherein the step of recirculating air includes the steps of selectively exhausting a portion of the circulating air containing moisture drawn from the plurality of stacks of lumber and introducing additional air into the kiln chamber wherein the additional air has a lower moisture content than the exhausted air.

16. A method for drying lumber according to claim 12 wherein the step of circulating air includes the step of passing air over the upper surface of each of the rectangular solid stacks of lumber.

17. A method for drying lumber according to claim 12 further comprising the step of heating the air prior to said circulating step to facilitate moisture removal from the plurality of stacks of lumber.

18. A method for drying lumber according to claim 12 wherein each stack of lumber is comprised of a plurality of stacked rows of lumber, the drying method further comprising the step of spacing the stacked rows such that air may flow between said rows to remove moisture therefrom.

19. A method for drying lumber according to claim 18 wherein the step of spacing the rows of lumber includes the step of placing a plurality of spaced apart stickers between each row of lumber.

20. A method for drying lumber according to claim 12 wherein the charge of lumber is comprised of a longitudinal row of a plurality of individual stacks of lumber, and wherein the step of covering a portion of the air space between adjacent stacks of lumber includes the step of covering the vertically extending air space defined between each laterally spaced pair of stacks of lumber.

21. A method of increasing the efficiency of drying green lumber, comprising the steps of:

introducing a charge of lumber into a kiln chamber wherein the charge of lumber comprises a plurality of rectangular solid stacks of lumber;

sealing the kiln chamber such that air is controllably introduced into and exhausted from the kiln chamber;

circulating air through the stacks of lumber in the sealed kiln chamber to thereby draw moisture from the stacks of lumber; and preventing circulating air that exits from one of the stacks from rising above the plurality of stacks of lumber in the vertically extending air spaces therebetween such that air circulates through each successive stack of lumber in the kiln chamber to thereby dry the lumber in each stack more evenly and efficiently.

22. A method of increasing the efficiency of drying lumber according to claim 21 wherein the step of preventing circulating air from rising above the stacks of lumber includes the step of covering a portion of the air spaces extending between the upper surfaces of adjacent stacks of lumber to prevent air from rising above the stacks of lumber in the air spaces.

23. A method of increasing the efficiency of drying lumber according to claim 22 wherein said covering step comprises covering the air spaces with an elongate center bridging panel comprising a center portion extending laterally substantially across the air space and having opposed side edges, and first and second side portions hingedly connected to the opposed side edges of the center portion, and wherein the method further comprises:

raising the first and second side portions prior to the introduction of lumber into the kiln chamber; and lowering the first and second side portions to a deployed position following the introduction of the lumber such that the first and second side portions extend downwardly from the center portion to contact the upper surfaces of adjacent, laterally spaced stacks of lumber to more efficiently prevent circulating air from rising above the stacks of lumber.

24. A method of increasing the efficiency of drying lumber according to claim 21 wherein the step of directing the circulating air further comprises the step of recirculating at least a portion of the air through the stacks of lumber in said kiln chamber to further dry each stack of lumber.

25. A method of increasing the efficiency of drying lumber according to claim 24 wherein the step of recirculating the air includes the steps of selectively exhausting a portion of the circulating air containing moisture drawn from the stacks of lumber and introducing additional air into the kiln chamber wherein the additional air has a lower moisture content than the exhausted air.

26. A method of increasing the efficiency of drying lumber according to claim 21 further comprising the step of heating the air prior to its circulation to facilitate moisture removal from each the stack of lumber.

27. A method of increasing the efficiency of drying lumber according to claim 21 wherein the step of circulating air includes the step of passing air over the upper surface of each of the rectangular solid stacks of lumber.

28. A method of increasing the efficiency of drying lumber according to claim 21 wherein each stack of lumber is comprised of a plurality of stacked rows of lumber, and wherein the step of introducing lumber into a kiln chamber includes the step of spacing the stacked rows of lumber such that air may flow between the rows to remove moisture therefrom.

29. A method of increasing the efficiency of drying lumber according to claim 28 wherein the step of spacing the rows of lumber includes the step of placing a plurality of spaced apart stickers between each row of lumber.

30. A method of increasing the efficiency of drying lumber according to claim 21 wherein the charge of lumber is comprised of a longitudinal row of a plurality of individual stacks of lumber, and wherein the step of preventing circulating air that exits from one of the stacks from rising above the plurality of stacks of lumber includes the step of covering a portion of the air space between each laterally spaced pair of stacks of lumber.

* * * * *